US006508246B1

(12) United States Patent
Fiedler

(10) Patent No.: US 6,508,246 B1
(45) Date of Patent: Jan. 21, 2003

(54) MECHANICAL DRAFT CONTROLLER

(76) Inventor: Lon W. Fiedler, 1301 Palace Ave., St. Paul, MN (US) 55105

( * ) Notice: Subject to any disclaimer, the term of this patent is extended or adjusted under 35 U.S.C. 154(b) by 0 days.

(21) Appl. No.: 09/716,001

(22) Filed: Nov. 17, 2000

(51) Int. Cl.[7] ..... F23L 11/00
(52) U.S. Cl. ..... 126/292; 137/520; 137/527.8
(58) Field of Search ..... 126/292, 307 R, 126/312; 110/163; 137/520, 527.8; 454/30

(56) References Cited

U.S. PATENT DOCUMENTS

| | | | | |
|---|---|---|---|---|
| 2,232,981 A | * | 2/1941 | Swanson | 137/520 |
| 3,886,853 A | | 6/1975 | Werling et al. | |
| 3,888,166 A | | 6/1975 | Stottmann | |
| 4,189,296 A | | 2/1980 | Hayes | |
| 4,276,871 A | | 7/1981 | Lindtveit | |
| 4,384,672 A | * | 5/1983 | Kutzner et al. | 126/292 |
| 4,437,454 A | | 3/1984 | Hayes | |
| 4,777,932 A | | 10/1988 | Pennington | |
| 4,846,400 A | | 7/1989 | Crouse | |

FOREIGN PATENT DOCUMENTS

| | | | |
|---|---|---|---|
| EP | 141944 A1 | * | 5/1985 |
| GB | 2147392 A | * | 5/1985 |

* cited by examiner

*Primary Examiner*—Sara Clarke
(74) *Attorney, Agent, or Firm*—Nawrocki, Rooney & Sivertson, P.A.

(57) ABSTRACT

The present invention is a mechanical draft controller. The draft controller is comprised of a draft controller portion, a means for pivoting the controller portion, and a means for counterbalancing the controller portion. The draft controller portion has a surface that is movable in a generally arcuate path with respect to a central axis, a second surface extending between the first surface and the central axis, and two side surfaces extending between the first surface and the central axis. The side surfaces are spaced apart and have the second surface oriented between the side surfaces.

20 Claims, 4 Drawing Sheets

MECHANICAL DRAFT CONTROLLER

BACKGROUND OF THE INVENTION

The present invention is generally related to the field of heating devices, such as furnaces, water heaters, boilers, and the like. In particular, the present invention relates to a device for the control of draft in the flue stack of a heating device.

In order for a heating device to operate at its optimal level, the pressure across the heating device must be optimal. This is accomplished by creating enough energy in the heating device's combustion chamber to allow some excess energy to escape out the flue stack of the heating device. The escape of the excess energy in the form of heated flue gas creates a draft out of the combustion chamber, up the flue stack, and out into the atmosphere. The draft allows the introduction of fresh air containing oxygen that fuels the combustion in the furnace.

However, if a high negative pressure occurs in the stack, the heating device will lose too much energy to the atmosphere and is, therefore, unable to create heat efficiently. This condition is typically caused by having a flue stack that is too large in height or in diameter for the combustion chamber.

For example, oftentimes when a heating device is replaced, a large combustion chamber is replaced by a smaller one, but the size of the flue stack is not changed. The size of the stack will be too large and will draw too much energy into the atmosphere, thereby creating an unsuitable environment for efficient heat production.

Alternatively, wind outside the flue stack may cause an additional draft which produces an excessive negative pressure. This condition is also not conducive to the production of heat in the heating device because the negative draft will draw too much air through the combustion process, thereby reducing the combustion temperature and reducing the efficiency of the heating device.

Several specific types of draft diverters and controllers have been developed to control the draft within the flue stack of a heating device. The simplest system of controlling the draft of a heating device is called a draft diverter. A draft diverter provides a means for allowing ambient air from the room, in which a heating device is located, to bypass the combustion process and thereby relieve the pressure across the combustion chamber.

Typically, an aperture is placed in the side of the flue which allows room temperature air from outside the flue to enter the flue pipe and be exhausted into the atmosphere instead of the heated air from within the combustion chamber, when a strong negative pressure is present. Additionally, heated air from the heating device is able to enter the room surrounding the heating device, thereby relieving pressure from the flue in cases of excessive positive pressure conditions.

In the case of negative pressure situations, the ambient air from the room surrounding the heating device may also be pulled through the draft diverter, up the flue stack and out into the atmosphere, thereby losing valuable heated air without providing a substantial benefit to the heating device. The problem with these systems is that they cannot be controlled and are, therefore, inefficient with regard to heated air being drawn out of the flue pipe space in order to prevent excess air being drawn through the heating device. The combustion chamber runs more efficiently, but the system as a whole does not run efficiently because the energy used to heat the room air when the room air is relieved through in the draft diverter. Also the pressure controlling ability of the device is limited to low pressures, because at higher pressures the diverter draws excessive amounts of warm room air through the draft diverter.

Another apparatus used to regulate the draft in a flue is a barometric damper. This apparatus works similar to the draft diverter. The barometric damper provides a cover over the open bypass hole in the flue. The cover is designed to open when the pressure in the flue exceeds the pressure limits of the combustion chamber. This saves energy as compared to the draft diverter because heated air from the space is not exhausted until a certain negative pressure has been reached. The device does not provide protection against high negative pressure because it acts like a draft diverter once the damper is open. This means that heated gas from the combustion chamber is drawn out of the stack instead. The barometric damper is a mechanical apparatus that responds to the change in pressure within the flue stack. The apparatus only responds to drastic changes in pressure and thereby does not keep the combustion chamber operating optimally, but merely relieves excessive pressure in order to keep the chamber operational.

The most sophisticated draft controller is an automatic draft control damper. The automatic damper is located within the flue and is generally designed having a flap that closes across the area of the flue stack. This damper has a better ability to control negative pressure than the barometric damper because the automatic damper modulates, through the use of an electric motor, to restrict the flow of flue gas leaving the heating device. The pressure drop across the damper counteracts the negative stack pressure resulting in a proper pressure across the heating device.

The automatic damper does not utilize an open bypass and thereby also saves energy due the fact that it does not draw any heated air out of the room surrounding the heating device. The problem with the automatic damper is that, due to its complexity and electronic control system, it is expensive, typically costing 10 times the cost of a barometric damper.

Accordingly, a device should be designed to restrict the size of the flue stack when negative pressure is present and allow a regulated flow of flue gases when positive pressure exists. The device should also be able to modulate to counter any negative pressure in the stack to maintain a set pressure at the heating device exit. Furthermore, the device should have a simple construction and be inexpensive to manufacture and maintain.

The present invention addresses these needs, as well as other problems associated with existing devices for controlling draft within a flue stack.

SUMMARY OF THE INVENTION

The present invention is a mechanical draft controller. The draft controller is comprised of a draft controller portion, a means for pivoting the controller portion, and a means for counterbalancing the controller portion. The draft controller portion has a surface that is movable in a generally arcuate path with respect to a central axis, a second surface extending between the first surface and the central axis, and two side surfaces extending between the first surface and the central axis. The side surfaces are spaced apart and have the second surface oriented between the side surfaces. The design of the device allows it to pivot into and out of the flow of gas in the flue depending upon the pressure of the flue gas stream, thereby modulating the pressure by restricting the area within the flue stack.

The aforementioned benefits and other benefits of the invention will become clear from the following description by reference to the accompanying drawings.

DETAILED DESCRIPTION OF THE INVENTION

Figure 1:
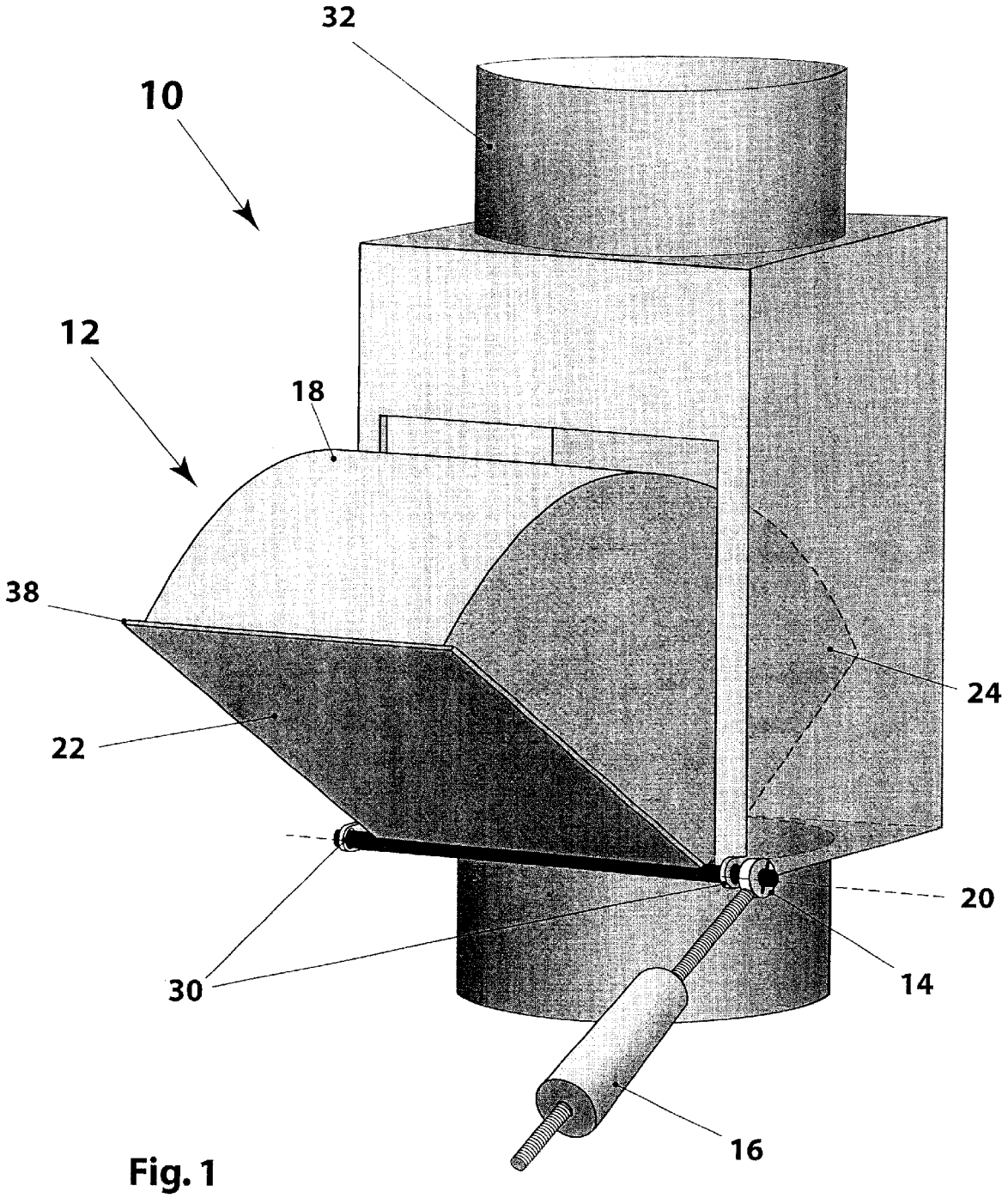
FIG. 1 is a side view of the present invention, in a modulating position, with one side of the flue stack removed to show the device's position.

Referring now to the drawing, wherein like reference numerals denote like elements throughout the several views, FIG. 1 illustrates the present invention in a modulating position. As shown in FIG. 1, the device 10 is comprised of a draft controller portion 12, a means for pivoting the draft controller portion 14, and a means for counterbalancing the draft controller portion 16.

The draft controller portion 12 is comprised of a first surface 18 that is movable in a generally arcuate path with respect to a central axis 20 and an end surface 22 that extends between the first surface 18 and the central axis 20. It is preferred that the end surface 22 extend from first surface 18 at its rear edge 38. The surface 18 may be of any suitable shape known in the art. Preferably, the first surface 18 has an arcuate shape arching around the central axis 20.

Figure 2:
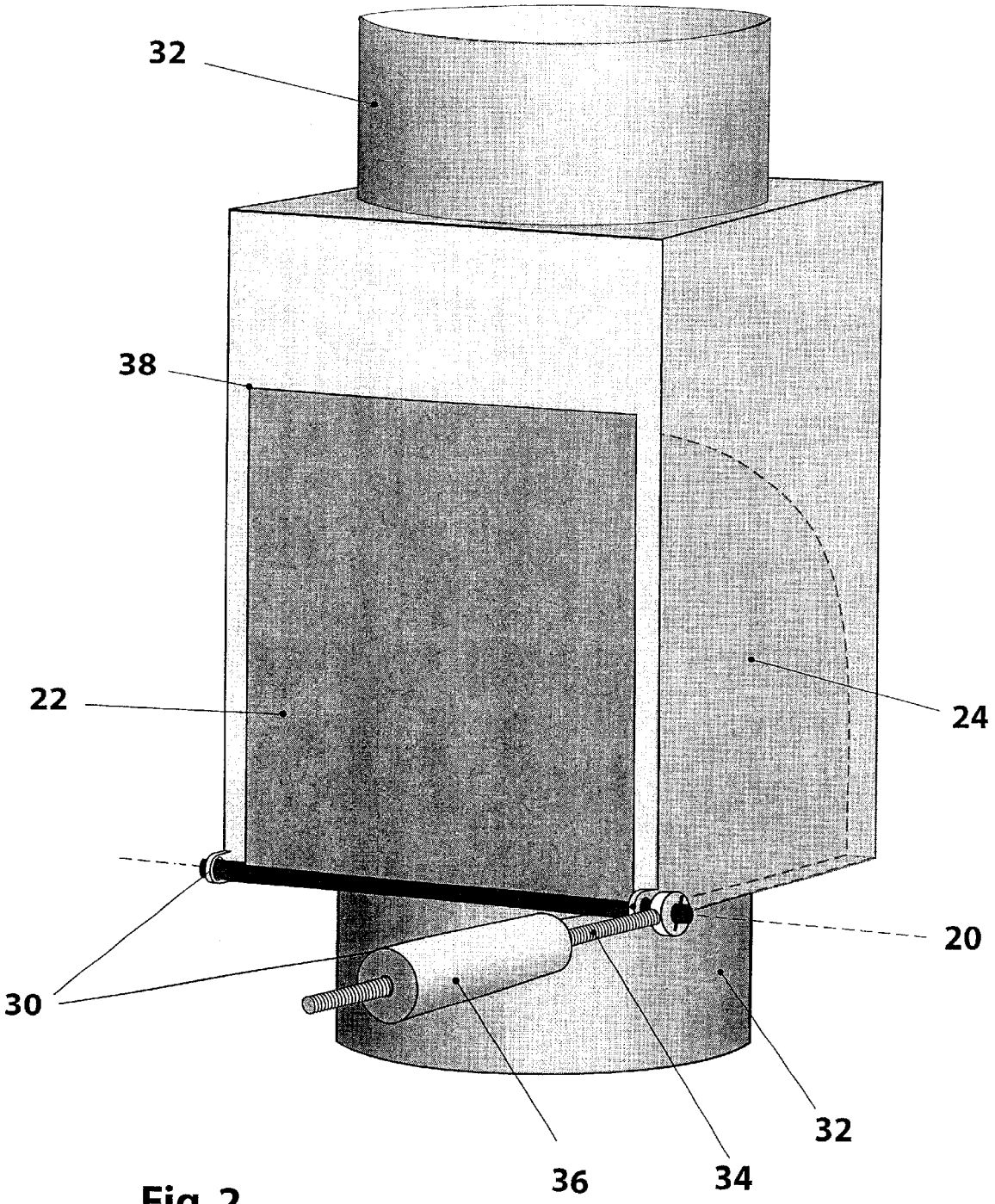
FIG. 2 is a side view of the device, with one side of the flue stack removed to show the device's position, of FIG. 1 in its closed position.
Figure 3:
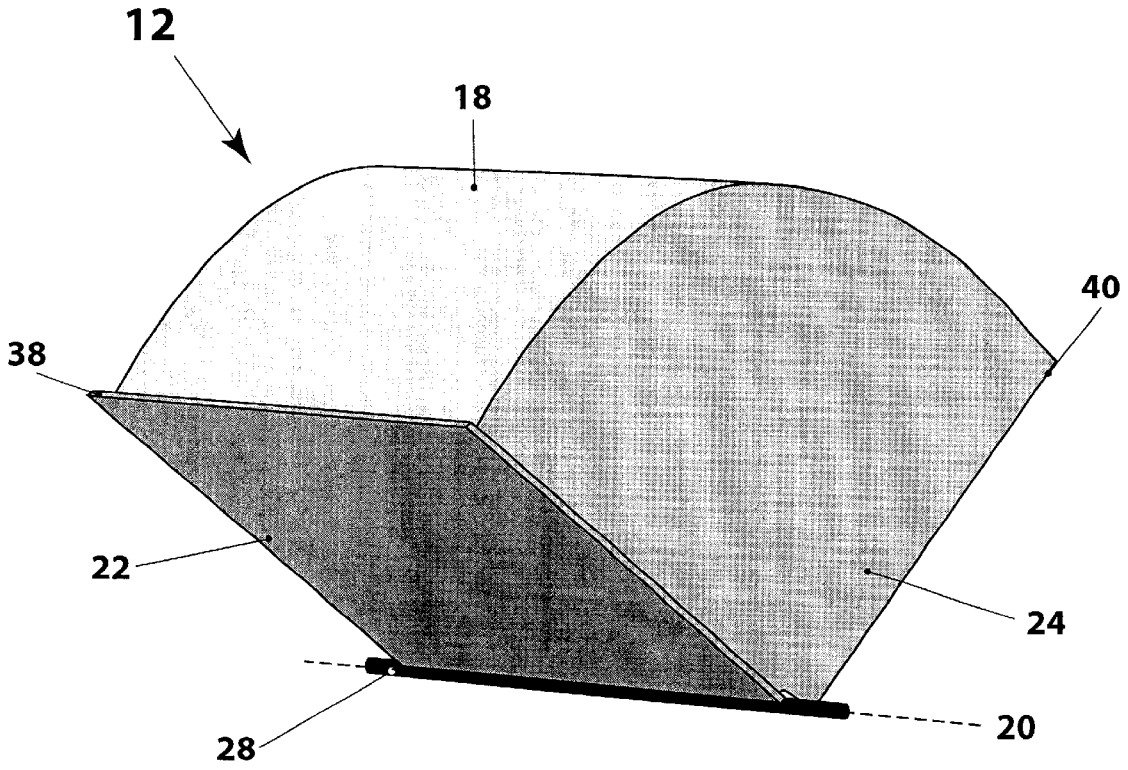
FIG. 3 is a side perspective view of the draft controller portion of the embodiment of FIGS. 1 and 2.
Figure 4:
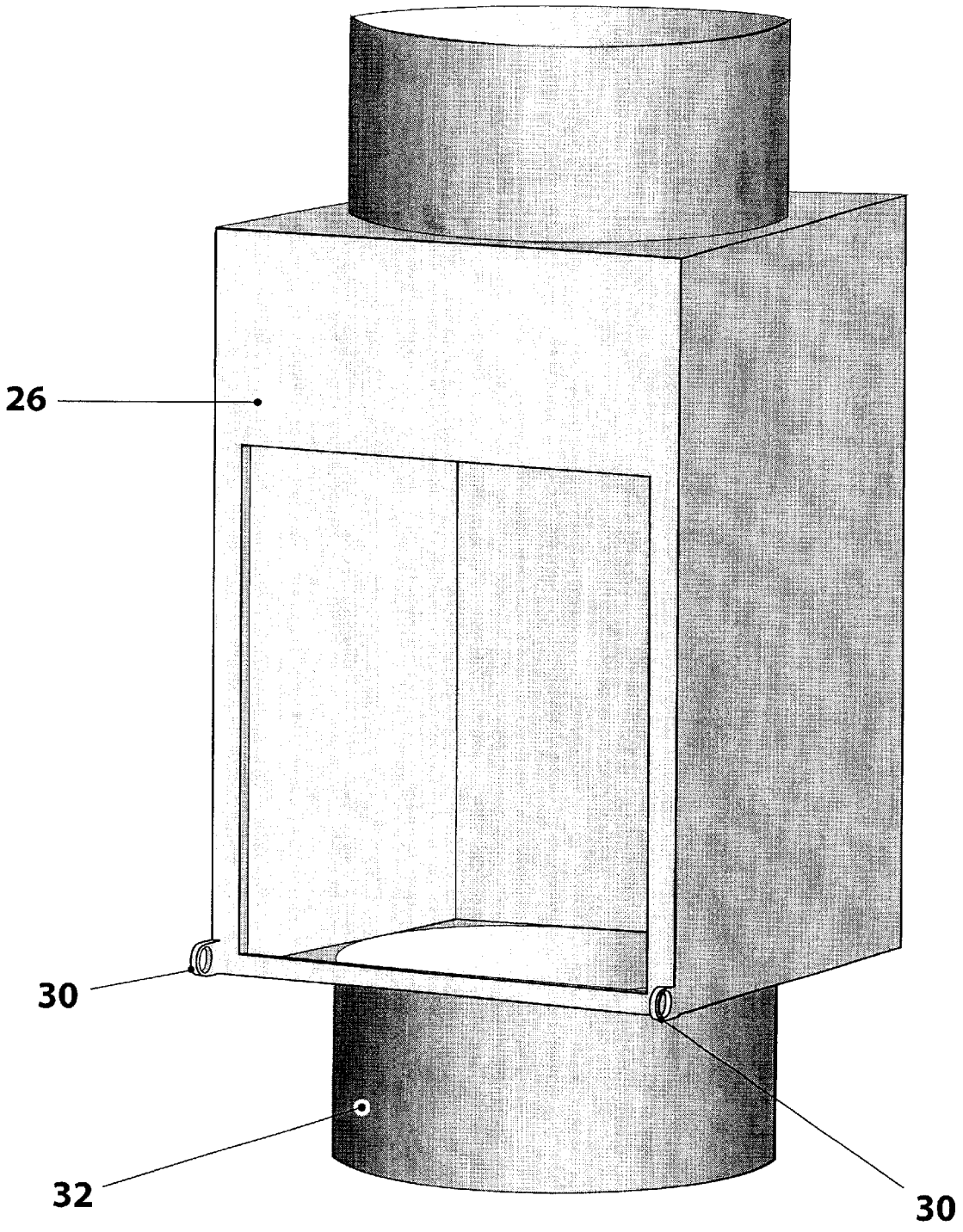
FIG. 4 is a side perspective view of a portion of the flue stack constructed and arranged to engage the draft controller portion of FIG. 3.

Also, as shown in FIGS. 1–3, the draft controller 10 has side members 24 that extend from the first surface 18 to the central axis 20. The side members 24 constrict the amount of ambient air that is pulled through the opening 26 from the room surrounding the heating device. As shown in FIGS. 1 and 2, the device 10 and opening 26 are preferably constructed having a tight fit between the device's outer surfaces 18 and 24 and the edges of opening 26, however, the device 10 should still be able to pivot freely.

Additionally, the draft controller 10 preferably has a front surface that extends between the first surface 18 and the central axis 20. It is preferred that the front surface extend from the first surface 18 at its front edge 40. The first surface may have any suitable shape. For example, the first surface, as viewed along its front edge, is preferably parallel to the central axis. The first surface, as viewed from the side, preferably has an arcuate shape that is arched around the central axis, as shown in FIGS. 1–3. It is foreseeable that the draft controller portion 12 is comprised of a solid piece of material. The draft controller portion may be comprised of any suitable material known in the art. The material must be able to withstand the temperatures of flue gases within the flue stack. For example, in most instances, sheet metal may be utilized to form the exterior surfaces of the draft controller portion 12.

The device 10 is preferably constructed to block the entire circumference of the flue stack, when fully deployed. As shown in FIGS. 1–4, if it is desired to have the entire circumference of the stack blocked, a portion of the stack may be replaced with an enlarged portion, thereby ensuring that the stack is blocked. The preferred shape of the added portion is rectangular, thereby allowing the front edge of surface 18 to be linear and parallel to the central axis 20.

The device may also be employed in configurations other than that shown in the figures. For example, the device may be oriented within a duct system, such as at a T-shaped junction between ducts, wherein the device modulates the flow of gas or air between three branches of the T. The device may also be inverted, having the means of counterbalancing oriented above the draft controller portion.

The means for pivoting the draft controller portion may be provided by any means known in the art. For example, as shown in FIGS. 1 and 2, the means for pivoting is provided by an elongate rod 28 oriented along the central axis 20, each of the ends of the rod 28 being received by a ring 30 on housing 32 attached to the exterior of the flue stack.

The means for counterbalancing the draft controller portions may be of any design and constructed from any material known in the art. For example, as shown in FIGS. 1 and 2, the device 10 is equipped with an arm 34 having a weight 36 attached to one end. The arm 34 is attached to the rod 28 and may be attached by any means known in the art. The means for counterbalancing may be adjustable or removable so that if pressurization conditions change, the controller can be adjusted to the new conditions. The weight 36 may be adjustable so that the controller can be fine tuned to specific pressurization conditions. The means for adjustment may be any means known in the art. For example, the arm 34 may be threaded to receive a weight 36 having a hole with internal threading therethrough. However, if a fixed weighting system is used, the adjustment is primarily done automatically, with the negative pressure in the building space pushing the damper closed, and the positive pressure (positive because of the pressure drop across the damper) in the flue pushing the damper open.

Since many possible embodiments may be made of the present invention without departing from the scope thereof, it is to be understood that all matter herein set forth or shown in the accompanying drawings is to be interpreted in the illustrative and not limiting sense.

What is claimed is:

1. A mechanical draft controller, comprising:

a) a draft controller portion having a first surface movable in a generally arcuate path with respect to a central axis, said first surface having a front and a back edge, a second surface extending between said first surface and said central axis, said second surface having attached at said front edge of said first surface, a third surface attached at said back edge and extending from said first surface to said central axis, and two side surfaces extending between said first surface and said central axis, said side surfaces spaced apart having said second surface oriented between said side surfaces;

b) means for pivoting said controller portion around said central axis; and c) means for counterbalancing said controller portion.

2. The controller according to claim 1, wherein said first surface is a generally planar shape.

3. The controller according to claim 1, wherein said first surface is a generally acurate shape.

4. The controller according to claim 1, wherein said second surface is attached at said back edge.

5. The controller according to claim 1, wherein said first surface has a front edge and wherein said front edge is arched with respect to said central axis.

6. The controller according to claim 1, wherein said means for pivoting is comprised of a rod connected to the an end of at least one side surface and is aligned along said central axis.

7. The controller according to claim 6, wherein said means for counterbalancing is provided by at least one weight fixed to said rod.

8. The controller according to claim 6, wherein said means for counterbalancing is provided by an arm extending from said rod and having a weight mounted to said arm.

9. The controller according to claim 8, wherein said weight is adjustably mounted to said arm.

10. The controller according to claim 1, wherein said controller is pivotably mounted to a flue stack.

11. The controller according to claim 1, wherein said means for pivoting is comprised of a rod oriented along the central axis and attached to said side surfaces and said second surface.

12. The controller according to claim 1, wherein said controller is a solid structure.

13. The controller according to claim 1, wherein said controller is a hollow structure.

14. The controller according to claim 1, wherein said means for counterbalancing is provided by a weight.

15. The controller according to claim 14, wherein said weight is fixed to said controller portion.

16. A mechanical draft controller, comprising:

a) a draft controller portion having a first surface, a second surface, a third surface, and two side members extending outward from said surface, each said side member terminating in an end, said surface having a front and a back edge, said second surface extending between said side members, said second surface being attached at said front edge of said first surface, said third surface attached at said back edge and extending between said side members;

b) a pivot structure engaged with said terminating ends of said side members; and c) a counterbalance portion attached to said controller portion.

17. The controller according to claim 16, wherein said first surface is moveable in an arcuate path with respect to a central axis.

18. A mechanical draft controller, comprising:

a) a draft controller portion having a first surface movable on an arcuate path with respect to a central axis, said first surface having a front edge, a back edge, and two side edges, said controller having a front surface attached to said front edge, a back surface attached to said back edge, and two side surfaces attached to said side edges, said front, back, and side surfaces extending outward from said first surface and terminating at the central axis;

b) a pivot structure comprised of a rod, oriented along the central axis, having two ends and being attached between the terminating ends of said side members; and c) a counterbalance portion, attached to said rod, comprising an arm extending from said rod, in a direction normal to said rod, and said arm having an end and having a weight attached to the end of said arm, said counterbalance portion arranged to counterbalance the weight of the controller portion.

19. The draft controller according to claim 18, wherein weight is attached to said arm by being threaded onto said arm, said threads being constructed to allow the weight to be adjusted toward and away from said central axis.

20. The draft controller according to claim 18, further comprising a housing, attached to a flue stack, having a square cross-section, a plurality of fixed rings being attached to the exterior thereof and each said rod end received in a pivoting relation by one of said fixed rings.

* * * * *

UNITED STATES PATENT AND TRADEMARK OFFICE

CERTIFICATE OF CORRECTION

PATENT NO. : 6,508,246 B1
DATED : January 21, 2003
INVENTOR(S) : Lon W. Fiedler

It is certified that error appears in the above-identified patent and that said Letters Patent is hereby corrected as shown below:

Column 5,
Line 30, thereof, between "said", first occurrence and "surface,", insert -- first --.

Signed and Sealed this

Sixth Day of September, 2005

JON W. DUDAS
*Director of the United States Patent and Trademark Office*